United States Patent [19]

Pickles

[11] 3,965,618

[45] June 29, 1976

[54] PROGRAMMED SEQUENTIAL OPERATOR

[75] Inventor: Joseph Pickles, Birmingham, Mich.

[73] Assignee: Ferro Manufacturing Corporation, Detriot, Mich.

[22] Filed: Mar. 1, 1974

[21] Appl. No.: 447,158

[52] U.S. Cl. ..... 49/103; 49/349; 49/350; 74/435

[51] Int. Cl.[2] ..... E05F 5/12

[58] Field of Search ..... 49/103, 220, 227, 348, 49/349, 350; 74/435

[56] References Cited

UNITED STATES PATENTS

| | | | |
|---|---|---|---|
| 2,868,032 | 1/1959 | Miller | 74/435 X |
| 3,392,488 | 7/1968 | Werner | 49/349 |
| 3,613,312 | 10/1971 | Wolak et al. | 49/220 |
| 3,745,703 | 7/1973 | Francis et al. | 49/103 |
| 3,816,962 | 6/1974 | Ladd et al. | 49/103 |
| 3,816,963 | 6/1974 | Hartmeyer et al. | 49/103 |

*Primary Examiner*—Philip C. Kannan
*Attorney, Agent, or Firm*—Whittemore, Hulbert & Belknap

[57] ABSTRACT

A programmed sequential operator for producing sequential or at least not identically simultaneous movement of two different members. The operator includes an actuator reversely movable between limiting positions, first and second operating members each independently reversely movable between limiting positions, and connections between the actuator and operating members to produce forward and reverse movements of said members in programmed relation to forward and reverse movement of the actuator.

14 Claims, 13 Drawing Figures

FIG. 2
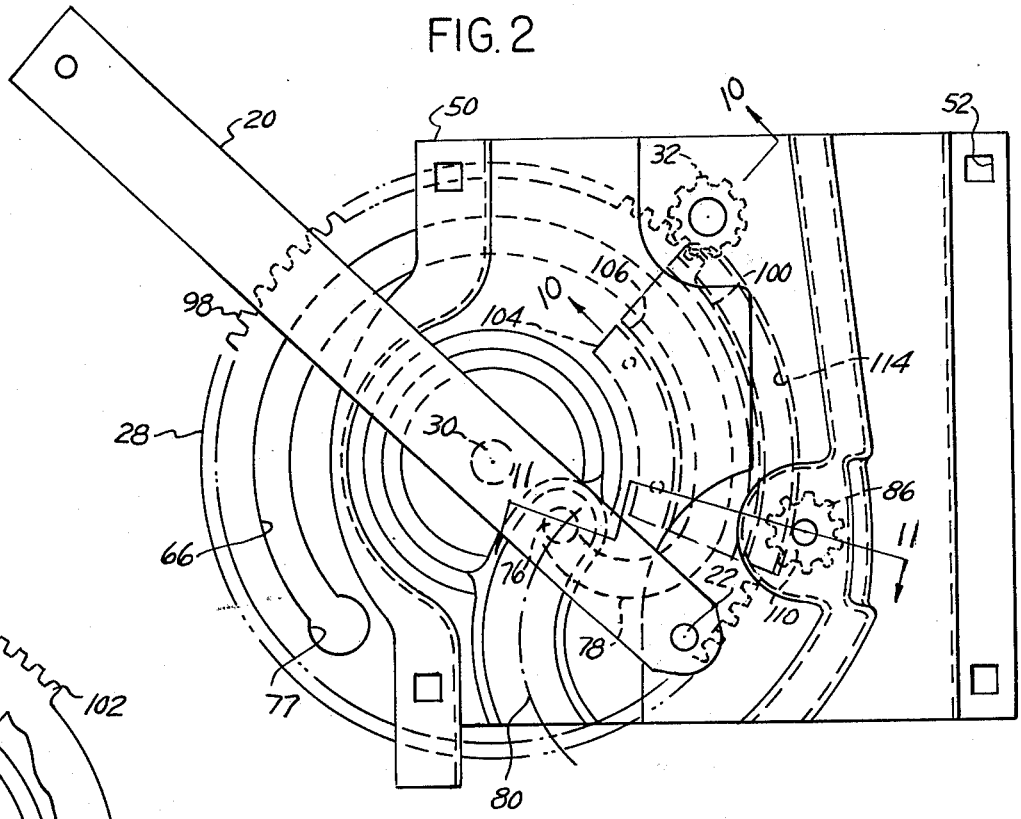
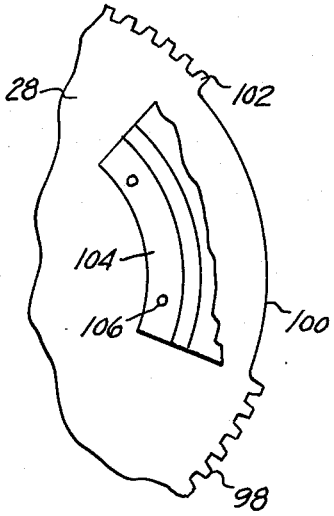
FIG. 4
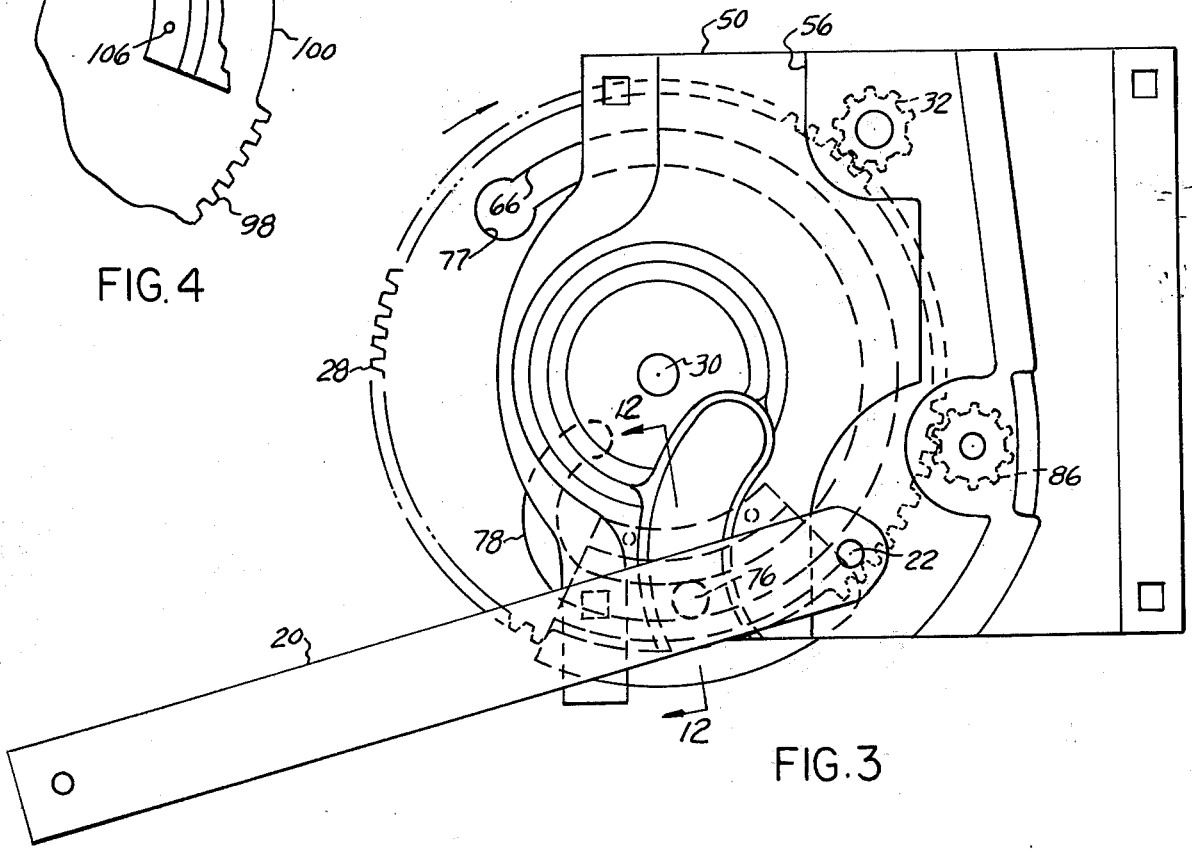
FIG. 3

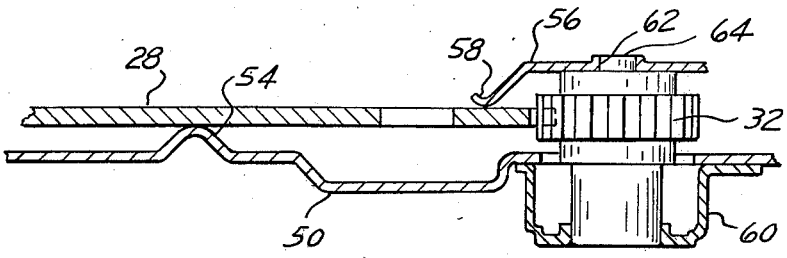
FIG. 10
FIG. 11
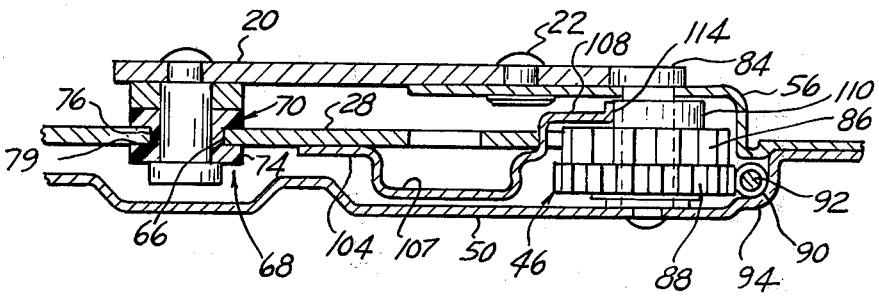
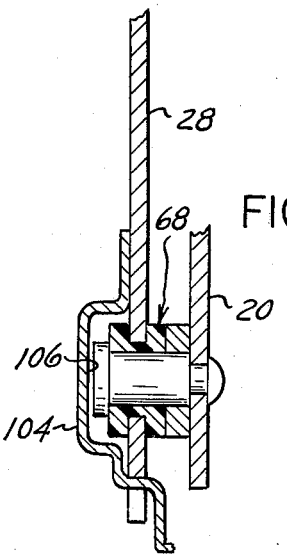
FIG. 12
FIG. 13
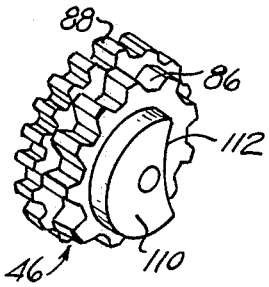

PROGRAMMED SEQUENTIAL OPERATOR

BRIEF SUMMARY OF THE INVENTION

The present invention relates to a programmed sequential operator adapted to effect forward and reverse movements between limiting positions of two different devices upon forward and reverse movement of a single actuator. The invention is illustrated as applied to effecting movement of two independently movable closure elements which together are adapted to form a complete closure for an opening, such for example as the opening in the door of an automotive vehicle. Generally, these closure elements include a large glass window capable of closing the major area of the window and a small glass closure usually referred to as a mini-vent.

The window and mini-vent are associated with means adapted to guide them as they move between open and closed position, but in the present disclosure such guide means are not illustrated or described since their details form no part of the present invention.

The actuation of the main closure and mini-vent is herein illustrated and described as being actuated by a single mechanically operated crank which in turn rotates a pinion in mesh with a gear. Rotation of the crank in one direction when the main window and mini-vent are both in closed position first moves one of the members, usually the mini-vent, to fully open position after which it is effective to move the main window to fully open position. Upon reverse movement of the crank the main window is first moved to closed position and thereafter the mini-vent is moved to closed position.

In accordance with a specific embodiment of the present invention, means are provided for locking the main closure in closed position while the mini-vent may be moved between open and closed position. The particular means to accomplish this purpose comprises camming means for blocking a transmission element in the train connecting to the main window, to prevent rotation of the transmission element.

More specifically, the foregoing is accomplished by the provision of a relatively large gear having a peripheral portion in which the teeth have been eliminated. The gear includes a cam slot. An actuating lever is provided having a cam follower movable in the slot. The cam slot includes a substantially arcuate portion concentric with the axis of rotation of the gear so that during rotation of the gear while the cam follower is in the concentric position of the slot, the arm is motionless and is positively blocked against movement by the cam follower and slot.

The portion of the cam slot which is not concentric with the action of rotation of the gear is located in such relation to the tooth gap portion of the gear that while the arm is being swung to impart movement to one of the window portions, for example the mini-vent, the tooth gap of the gear moves past a pinion which is part of a transmission system extending to the actuator for the other window portion, for example the main window.

Specifically, the other window portion is actuated by means of a flexible actuator including a flexible rack portion movable longitudinally in a guide tube. The flexible rack portion includes a wrapping of wire extending helically around a flexible core and the transmission means includes a pinion engageable with the teeth formed by the wire wrapping. The pinion which is in mesh with the flexible rack is fixedly associated with a second rack adapted to mesh with the teeth of the gear so that as a toothed portion of the gear moves past the gear pinion, the pinion is rotated and also the rack pinion is rotated, moving the flexible rack in one direction or the other. However, when the tooth gap on the actuating gear moves into the zone occupied by the gear pinion, a camming surface provided on the actuator gear moves into blocking engagement with a cooperating cam surface on a cam fixedly connected to the pinions. Thus, as the actuator gear rotates from one extreme position it causes movement of the swinging arm as a result of the cam slot and cam follower, while the camming surface on the gear at this time positively prevents rotation of the gear and rack pinions, and hence, blocks the flexible rack against longitudinal movement. Further movement of the gear brings the cam follower into engagement with a circular portion of the cam slot concentric with the actuating gear, which thus positively blocks the arm in closed position. Further movement of the actuating gear at this time moves the blocking cam out of engagement with the cam surface provided in association with the pinions while the first of a series of teeth on the actuating gear moves into engagement with the gear pinion and effects repeated rotation of it, accompanied of course by longitudinal movement of the flexible rack.

BRIEF DESCRIPTION OF THE DRAWINGS

FIG. 2 is an enlarged elevational view of the actuator showing the movable arm in one limiting position.

FIG. 3 is a view similar to FIG. 1 showing the arm in its other extreme position.

FIG. 4 is a fragmentary elevational view showing the relationship between the actuating gear, a tooth gap therein, and a camming element connected thereto.

FIG. 10 is a fragmentary sectional view on the line 10—10, FIG. 2.

FIG. 11 is a fragmentary sectional view on the line 11—11, FIG. 2.

FIG. 12 is a fragmentary sectional view on the line 12—12, FIG. 3.

FIG. 13 is a perspective view showing the relationship between the blocking cam and gear pinion.

DETAILED DESCRIPTION

Figure 1:
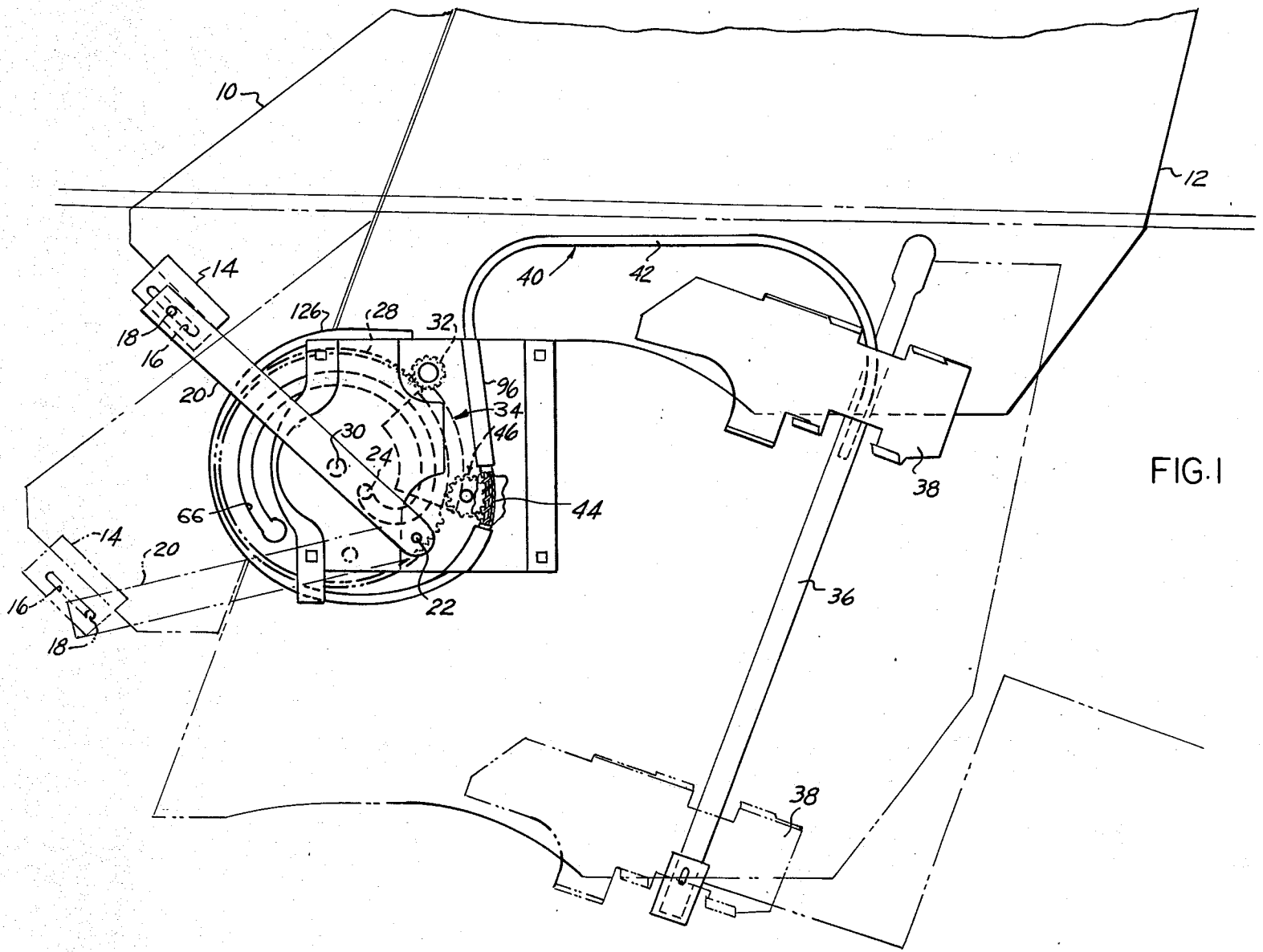
FIG. 1 is a more or less diagrammatic elevational view showing the relationship of the parts.

Referring now to FIG. 1 the actuator is shown as connected to a mini-vent 10 and a main window 12, each of which is independently movable generally upwardly but slightly inclined to the right as indicated by the side edges of the main window 12. Suitable guide and sealing means are provided between the adjacent edges of the closure members.

The mini-vent includes a bracket 14 having an elongated slot 16 therein which receives a pin 18 carried at the end of an arm 20 which has a fixed pivot mounting indicated at 22. The arm 20 has a cam follower indicated generally at 24 which is movable in a cam slot 66 provided in an actuating gear 28. As will be described subsequently, the cam slot 66 includes an inclined camming portion effective to move the arm 20 between the limiting positions shown, and another portion which is concentric with the pivot mounting 30 of the gear. When the follower is in the concentric portion of the cam slot, the arm 20 is of course retained against movement while the gear may be further rotated to produce movement of the main window.

The gear 28 is driven in rotation by a pinion 32 which may in turn be driven by a hand crank or if desired, by power means. The periphery of the gear 28 includes an untoothed portion referred to herein as a toothed gap, the location of which is indicated at 34 for a purpose which will presently appear. The main window 12 is vertically movable by means which include an upwardly inclined guide tube 36 and a rod (not shown) in said tube fixedly secured to a bracket 38 which is attached to the lower edge of the window 12. Vertical movement of the rod in the tube effects guided generally up and down movement of the window in a manner which is familiar in the art such for example as shown in Werner U.S. Pat. No. 3,280,509.

A transmission which includes push-pull mechanism indicated generally at 40 is connected between the input pinion 32 and the window supporting rod. This may comprise a flexible cable the major portion of which is confined within a tube 42. The cable is wrapped with wire which transforms it into a flexible rack 44 engageable with one side of a driving rack pinion later to be described, which constitutes a part of a compound pinion 46. In FIG. 1 the portion of the flexible rack engageable by the rack driving pinion which forms a part of the compound pinion 46 is shown in elevation but it will of course be understood that in the actual construction a portion of the tube 42 in which the flexible cable is longitudinally movable is cut away at only one side to permit meshing engagement between the teeth of the rack driving pinion and the flexible rack.

As more fully described in the Werner patent identified above, the flexible rack, by virtue of being confined in the tube 42, can serve as an effective motion transmitting means both in tension and compression. In other words, the flexible rack constitutes a push-pull element which may be suitably connected to the bracket 38, which in turn is connected to the lower end of the main window 12.

The arm 20 is shown in its two limiting positions and the main window bracket 38 is also shown in its two limiting positions. In accordance with the present invention, rotation of a hand wheel or other actuator connected to the pinion 32 is effective to move the mini-vent 10 from closed to open position and continued movement of the pinion 32 in the same direction then initiates downward movement of the main window 12 which is carried to completion. Reverse movement of the pinion 32 first moves the main window 12 and then moves the mini-vent 10 to its closed position.

Referring now to FIG. 2 and following, the actuator construction is shown in enlarged scale. The construction illustrated in its entirety in FIGS. 2 and 3 comprises a mounting plate 50 of generally rectangular configuration and provided adjacent its corners with openings 52 by means of which the plate may be attached to suitable support structure inside the vehicle door. The plate 50 is a sheet metal stamping and is configurated as best illustrated in sectional views 10 and 11. For example, in FIG. 10 a rib 54 is provided having a convexly rounded top surface engageable with the gear 28 to support the gear while at the same time minimizing frictional resistance to its rotation. Connected to the support plate 50 is a mounting bracket 56, the two plates preferably being welded together and adapted to support movable elements of the operator as will subsequently be described.

The support plate or bracket 56 is also in the form of a sheet metal stamping configurated to provide suitable reinforcement and to cooperate with the movable elements of the operator. Thus, as seen in FIG. 10, the edge of the support plate or bracket 56 is reversely bent as indicated at 58 to provide a convexly rounded support surface engageable with the opposite side of the gear 28. The surfaces of the rib 54 and the bent portion 58 provides adequate support for the gear 28.

The pinion 32 for rotating the gear 28 is journaled for rotation in housing cup 60 welded or otherwise suitably secured to the mounting plate 50, and an opening 62 is provided in the support plate to receive the shaft portion at one end of the pinion 32.

In order to provide for swinging movement of the arm 20 between the positions illustrated in FIGS. 2 and 3, the gear 28 is provided with a cam slot 66 having the major portion thereof extending concentrically with respect to the pivot mounting 30 of the gear 28. The pivot mounting 22 of the arm 20 is best seen in FIG. 11 and comprises a rivet extending through registering openings adjacent one end of the arm 20 and in the support plate 56. The arm 20 adjacent the pivoted end thereof is provided with a cam follower indicated generally at 68. The cam follower includes a follower roller 70, preferably formed of a low friction material such for example as an acetyl resin, having an annular groove intermediate its ends, the ends of the roller being enlarged as indicated at 74. The reduced intermediate cam follower portion of the roller is indicated at 76. The cam slot 66 is provided at one end with a circular enlargement 77 of a size which permits the roller to be introduced into alignment with the slot and then moved longitudinally along the slot with the edges of the slot received in the annular groove 79.

Adjacent one end, the slot 66 includes an abruptly radially inwardly curved portion 78. It will be apparent that when the follower 76 of the arm 20 occupies the position shown in FIG. 2, it is at the inner end of the abruptly curved portion 78 of the cam slot. Accordingly, as the gear 28 is moved clockwise from the position illustrated in FIG. 2, the follower roller is forced to move along the path indicated at 80 concentric with the pivot mounting 22 of the arm 20, until the arm reaches the position illustrated in FIG. 3. At this time the cam follower portion 76 occupies a portion of the slot 66 which is concentric with the pivot mounting 30 of the gear 28. Accordingly, at this time continued rotation of the gear 28 may take place without causing movement of the arm 20.

The additional movement of the gear 28 as referred to, which takes place without movement of the arm 20, is used to effect longitudinal movement of the flexible rack 44. For this purpose a compound pinion element 46, best illustrated in FIGS. 11 and 13, is provided. The compound pinion element is mounted for rotation by a pin 84 and includes a first pinion portion 86 having teeth adapted to mesh with the teeth on the toothed portion of the gear 28. In addition, the compound pinion element 46 includes a cable drive rack pinion portion 88 the teeth of which are adapted to mesh with the rack teeth formed by the wire convolutions indicated at 90 surrounding the flexible cable 92, these elements together making up the flexible rack 44. It will be observed that the pin 84 extends between the mounting plate 50 and the support plate 56, thus providing a secure mounting for the compound pinion element 46. It will be observed from FIG. 11 that the flexible rack, at the point where it is in mesh with the rack pinion 88, is supported by an appropriately curved shoulder portion 94 of the mounting plate 50. It may further be observed from FIG. 1 that the mounting plate is suitably stamped as indicated at 96 to receive a portion of the tube 42 extending between the plates.

As best seen in FIG. 4, the gear 28 has a portion of its periphery provided with teeth 98, these teeth being discontinued throughout a gap indicated at 100, so that at one side of the gap there is provided a tooth designated at 102 which is adapted to move into and out of mesh with the gear pinion 86. Associated with the gear 28 at the gap is a stop plate 104 adapted to be welded or otherwise secured to the gear 28 as indicated at 106. As best illustrated in FIG. 11 the stop plate 104 is formed as a sheet metal stamping having an arcuate channel 107 designed to permit movement of the cam follower roller 70 therethrough and includes a peripheral portion 108 shaped to extend beyond the upper end of the gear pinion 86 as seen in this Figure, into engagement with stop cam 110 provided on the compound pinion element 46. The stop cam 110, as best illustrated in FIG. 13 may conveniently be formed integrally with the compound pinion and includes a concave arcuate stop surface 112 the radius of curvature of which is equal to its displacement from the pivot mounting of the gear 28. The arrangement is such that as the gear 28 is rotated in a counterclockwise direction, the tooth 102 moves out of meshing engagement with the teeth of the gear pinion 86 just as the arcuate stop surface 112 moves into engagement with a flange 114 provided at the edge of the stop plate 104. Thereafter, the gear may continue to rotate although no rotation is transmitted to the pinion 86, which is out of mesh with the teeth of the gear. At the same time, the compound pinion element 46 is blocked against rotation as a result of engagement between the surface 112 of the compound pinion and the confronting surface of the flange 114.

Figure 5:
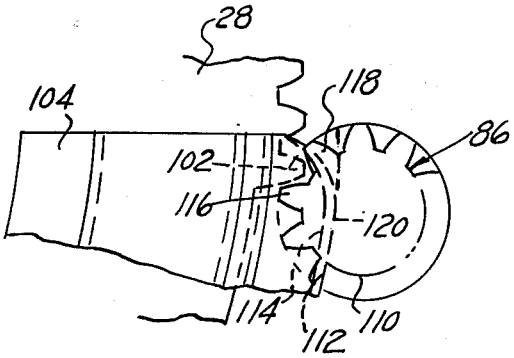

The foregoing is more readily apparent from an inspection of FIGS. 5–9. In FIG. 5 the tooth 102 of the gear 28 is positioned between teeth designated 116 and 118 of the pinion 86. At this time the arcuate concave surface 112 of the stop cam 110 engages the outwardly convex surface 120 of the flange 114 of the stop plate 104. Further counterclockwise movement of the gear 28 is permitted since its tooth 102 will not engage the tooth 118 of the pinion 86. At the same time the surface 120 of the stop cam 110 engages the concentric surface of the flange 114 so that as the gear 28 rotates in a counterclockwise direction, the pinion 86 is blocked against rotation. Since the pinion 86 is formed as an integral part with the flexible rack drive pinion 88, this means that the flexible cable is blocked against longitudinal movement and the main window 12 is thus blocked against vertical movement. This means that at this time the main window cannot be opened by forces applied directly to the window, constituting a safety feature.

Figure 6:
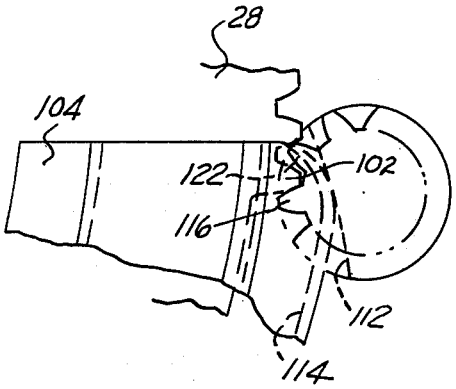

Referring now to FIG. 6 it will be observed that the flange 114 of the stop plate has an abruptly curved tail portion 122. As the gear 28 moves clockwise from the position shown in FIG. 5 to the position shown in FIG. 6, the concave cam surface 112 of the stop cam 110 is moved to the position illustrated by engagement between teeth 102 and 116.

Figure 9:
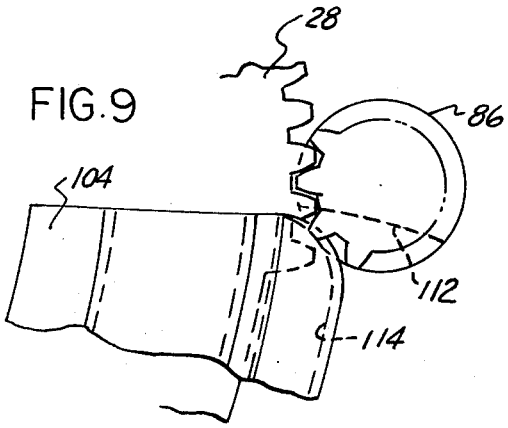
FIGS. 5–9 are elevational views showing sequential related positions of the actuating gear, the gear pinion, and blocking cam means associated therewith.
Figure 8:
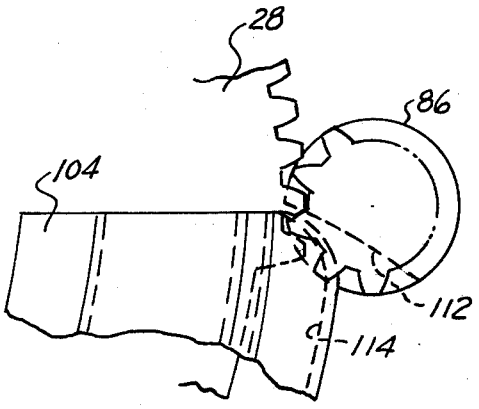
Figure 7:
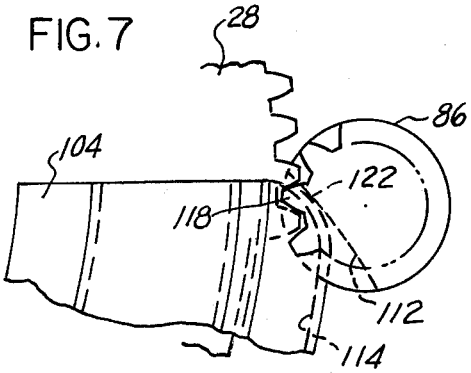

FIG. 7 illustrates the relative position produced by further clockwise movement of the gear 28 at which time the second tooth of the gear engages the tooth 118 of the pinion 86, the concave stop surface 112 having moved into engagement with the abruptly curved end portion 122 of the flange. The positions illustrated in FIGS. 8 and 9 represent the result of further movement and illustrate the gear 28 as assuming driving relation to the pinion 86 with of course no interference between the flange 114 of the stop plate 104 and the concavely curved surface 112 of the stop cam 110.

It is apparent from FIG. 13 that the rack pinion 88, the gear pinion 86, and the stop cam 110 all occupy different planes of rotation so that while the stop plate 104 moves from a position of engagement with the stop cam 110, the compound cam element 46 may make a plurality of revolutions.

Briefly reviewing the operation, and referring particularly to FIGS. 2 and 3, FIG. 2 may be considered as representing the relationship of parts after the arm 20 has just been moved to its uppermost position, thus moving the mini-vent 10 to closed position. The rotation of the gear 28 which moved the arm 20 to the position illustrated in FIG. 2 had previously moved the main window 12 to closed position.

At this time it will be observed that the flange 114 of the stop plate 104 is engaged with the concave cam surface of the stop cam 110.

If now, the driving pinion 32 is rotated in a counterclockwise direction, the result will be to rotate the gear 28 in a clockwise direction. At this time the gap 100 of the gear 28 is opposite the pinion 86 so that rotation of the gear will not effect rotation of the pinion and in fact, rotation of the pinion is blocked by engagement between its cam surface 112 and the surface of the flange 114 of the blocking plate 104. However, clockwise rotation of the gear 28 will immediately cause counterclockwise swinging movement of the arm 20 about its pivot mounting 22 as a result of the engagement between the cam follower portion 76 and the abruptly curved portion 78 of the cam slot 68. This movement of the arm 20 is completed by the time the gear 28 has moved to a position such that the cam follower portion 76 enters into the portion of the cam slot 66 which is concentric with the pivot mounting of the gear. At this time of course further rotation of the gear will not result in movement of the arm 20 and it will be retained in the lowermost position illustrated in FIG. 3.

Just as the cam follower portion 76 enters into the portion of the cam slot 66 which is concentric with the gear 28, the sequence of events illustrated in FIGS. 5–9 occurs, as a result of which the toothed portion of the periphery of the gear 28 enters into a meshing condition with the pinions 86 which is thus driven in rotation, rotation of the pinion 86 and hence of the rack pinion 88 is permitted as a result of disengagement of the flange 114 of the stop plate 104 from the concave cam surface 112 of the stop cam 110. Continued rotation of the gear pinion 32 will result in continued rotation of the gear 28, which in turn will result in multiple rotation of the pinions 86 and 88 in a counterclockwise direction as seen in FIGS. 2 and 3. This means that the portion of the flexible rack or cable 44 in mesh with the pinion 86 is pushed upwardly, which results in downward movement of the end of the flexible rack connected to the bracket 38. This in turn will result in movement of the window 12 from the full line position illustrated in FIG. 1 to the lower dotted line position thereof.

While the flexible rack is subjected to compressive forces at this time, it is confined in the tube 42 or in a suitably formed confining portion of the tube 36 which guides the window support bracket 38.

In order to accommodate the length of the flexible rack moving past the pinion 46 as the window 12 is moved upwardly, there is provided a curved tube 126 adapted to receive and confine such portion of the flexible rack.

When the window 12 reaches the fully opened position illustrated in dotted lines in FIG. 1, its further movement is arrested. In order to close the window, the input manually operated pinion 32 is driven in the reverse direction; namely, in a clockwise direction, thus imparting counterclockwise movement to the gear 28 which in turn will result in clockwise movement of the pinions 86 and 88 and will cause corresponding downward movement of the flexible rack 44 past the pinion 88. This continues until the window 12 reaches the uppermost fully closed position at which time the coaction between the stop plate 104 and the stop cam 110 prevents further rotation of the pinions 86 and 88 while the abruptly curved portion 88 of the cam slot 66 moves the mini-vent actuating arm 20 clockwise or upwardly to close the mini-vent.

What I claim as my invention is:

1. A programmed sequential operator comprising an actuator reversely rotatable between limiting positions, first and second operating members each independently reversely movable between limiting positions, connections between said actuator and said operating members effective to produce forward and reverse movements of said members in sequentially programmed relation to forward and reverse movement of said actuator, one of said members being a rotatable driven member, said connections comprising drive means operable to rotate said driven member during a part of the rotary movement of said actuator, and blocking means acting between said actuator and rotatable driven member to block said rotatable driven member against rotation during another part of the rotary movement of said actuator while providing for continued rotation of said actuator, said actuator having peripheral gear teeth and an edge portion in which teeth are omitted to form a gap, said rotatable driven member being in the form of a pinion adapted to mesh with the peripheral teeth of said actuator, a blocking cam connected to said actuator having a circumferentially extending arcuate convex surface at one side of the plane occupied by its teeth and located generally at said gap and concentric with the axis of rotation of said actuator, said pinion having a concave radially facing surface at one side of the plane of its teeth and in the plane of the arcuate convex surface of said blocking cam, said concave surface being conformed to the arcuate convex surface of said blocking cam to provide for continued rotation of said actuator while said pinion is blocked against rotation.

2. An operator as defined in claim 1, in which said pinion is connected to a drive pinion coaxial therewith, and a flexible rack in mesh with said drive pinion.

3. A regulator for independently movable closure members for providing programmed sequential opening and closing thereof and positive retention in closed position of at least one of said members when both are in closed position, comprising a programmed sequential operator comprising an actuator reversely rotatable between limiting positions, first and second operating members respectively connected to said closure members and each independently reversely movable between limiting positions, connections between said actuator and said operating members effective to produce forward and reverse movements of said members in sequentially programmed relation to forward and reverse movement of said actuator, said actuator having peripheral gear teeth and an edge portion in which teeth are omitted to form a gap, one of said connections comprising a pinion adapted to mesh with the peripheral teeth of said actuator, a blocking cam connected to said actuator having a circumferentially extending arcuate surface at one side of the plane occupied by its teeth and concentric with the axis of rotation of said actuator and located generally at said gap, said pinion having a concave radially facing surface at one side of the plane of its teeth and in the plane of the arcuate surface of said blocking cam, said concave surface being conformed to the arcuate surface of said blocking cam to provide for continued rotation of said actuator while daid pinion is blocked against rotation by said blocking cam.

4. A regulator as defined in claim 3 in which said pinion is connected to a drive pinion coaxial therewith, and a flexible rack in mesh with said drive pinion.

5. A regulator for independently movable closure members for providing programmed sequential opening and closing thereof and positive retention in closed position of at least one of said members when both are in closed position, comprising a programmed sequential operator comprising an actuator reversely rotatable between limiting positions, first and second operating members respectively connected to said closure members and each independently reversely movable between limiting positions, connections between said actuator and said operating members effective to produce forward and reverse movements of said members in sequentially programmed relation to forward and reverse movement of said actuator, one of said members being a pivoted lever, said actuator having a cam surface and a cam follower on said pivoted lever spaced from its pivot axis and in engagement with said cam surface, the connections between said actuator and the other of said members including a rotatable driven member, and blocking means acting between said actuator and rotatable driven member to block said rotatable driven member against rotation while providing for continued rotation of said actuator, said actuator having peripheral gear teeth and an edge portion in which teeth are omitted to form a gap, said rotatable driven member being in the form of a pinion adapted to mesh with the peripheral teeth of said actuator, a blocking cam connected to said actuator having a circumferentially extending arcuate surface at one side of the plane occupied by its teeth and concentric with the axis of rotation of said actuator, said pinion having a concave radially facing surface at one side of the plane of its teeth and in the plane of the arcuate surface of said blocking cam, the arcuate surface being located at the gap between the ends of the toothed portion of said actuator, said concave surface being conformed to the arcuate surface of said blocking cam to provide for continued rotation of said actuator while said pinion is blocked against rotation.

6. A sequential operator comprising an actuator reversibly movable in opposite senses, a series of driving teeth on said actuator having a gap at one end of said series at which driving action of said teeth terminates, a first driven member in the form of a pinion having a complete series of teeth arranged to mesh with the teeth of said actuator, movement preventing means acting between said actuator and said first driven member and adapted to provide for continued movement of said actuator in one direction upon termination of the driving action of said series of driving teeth while preventing further movement of said first driven member during continued movement of said actuator, a second movable member, cam means operatively connecting said actuator and said second movable member effective to initiate and continue movement of said second movable member during a predetermined part of the movement of said actuator which is independent of the part of the movement of said actuator during which said first driven member is driven thereby.

7. A window regulator comprising a drive gear having a series of peripheral teeth having a peripheral gap in which no teeth are provided, transmission means connecting said drive gear to a movable window including a pinion adapted to mesh with said gear, a first blocking member affixed to one side of said gear having a convex arcuate blocking surface concentric with said gear, a second blocking member affixed to one side of said pinion in the plane of said first blocking member and having a concave arcuate surface conforming to said convex surface and disposed to engage therewith in blocking relation as the last tooth of the series of teeth on said drive gear clears a mating tooth on said pinion to provide for continued rotation of said drive gear while rotation of said pinion is prevented.

8. A regulator as defined in claim 7 which comprises a rack, said pinion having teeth in mesh with the teeth of said rack, means connecting said rack to the movable window, said arcuate surfaces when engaged serving to prevent movement of the window by forces applied directly thereto.

9. A regulator as defined in claim 7 which comprises a flexible rack, a support tube in which said rack is longitudinally movable, said tube having an access opening, said pinion having teeth in mesh with the teeth of said rack at the access opening, means connecting said rack to the movable window, said arcuate surfaces when engaged serving to prevent movement of the window by forces applied directly thereto.

10. An actuator comprising a gear having a sequence of teeth separated by a gap in which no teeth are provided, a convex arcuate cam surface on said gear concentric therewith and spaced axially from the plane of the teeth and located circumferentially of said gear generally at said gap, a pinion having a complete series of teeth conjugate to the teeth of said gear, means supporting said gear and pinion for rotation at fixed positions in which the teeth of said gear and pinion may be in proper mesh, said pinion having affixed thereto a cam follower spaced axially from its toothed portion and having a concave generally arcuate surface of substantially the same radius of curvature as said arcuate cam surface and in the plane thereof, said concave surface being positioned to face outwardly from the axis of said pinion to engage said convex arcuate surface to block rotation of said pinion while said gear continues to rotate.

11. An actuator as defined in claim 10 in which said convex and concave cam surfaces are located relative to each other and to said gap such that the cam surfaces come into and leave blocking relation of said pinion just as the sequence of gear teeth at one side of said gap leave and come into driving engagement respectively with said pinion teeth.

12. An actuator as defined in claim 11 in which said convex cam surface has at one end thereof an abruptly curved convex portion shaped to cooperate with said concave cam surface to permit initial limited movement of said pinion following engagement between the tooth on said gear at one end of said gap and said pinion teeth.

13. Independently movable window and vent panels for an opening in a motor vehicle, means for moving the window panel between open and closed positions comprising a flexible guided rack connected thereto, a pinion member in mesh with said rack, a rotatable actuator having a series of peripheral teeth adapted to mesh with said pinion and a peripheral portion having a gap in which no teeth are provided, said actuator and pinion member having blocking cam means engageable as the gap of said actuator reaches said pinion member to provide for further rotation of said actuator while said pinion is blocked against rotation, and transmission means connecting said actuator and said vent panel operable to open and close said vent panel while said window panel is in closed position.

14. Structure as defined in claim 13 in which said transmission means comprises a pivoted lever connected to said vent panel, and cam means acting between said lever and actuator to swing said lever during rotation of said actuator.

* * * * *